US008255102B2

(12) United States Patent
Zanfei

(10) Patent No.: US 8,255,102 B2
(45) Date of Patent: Aug. 28, 2012

(54) STEERING UNIT FOR A STEER-BY-WIRE SHIP'S CONTROL SYSTEM AND METHOD FOR OPERATING THE STEERING UNIT

(75) Inventor: Adriano Zanfei, Madrano (IT)

(73) Assignee: ZF Friedrichshafen AG, Friedrichshafen (DE)

( * ) Notice: Subject to any disclaimer, the term of this patent is extended or adjusted under 35 U.S.C. 154(b) by 217 days.

(21) Appl. No.: 12/678,858

(22) PCT Filed: Sep. 26, 2008

(86) PCT No.: PCT/EP2008/062897

§ 371 (c)(1),
(2), (4) Date: Apr. 5, 2010

(87) PCT Pub. No.: WO2009/047134

PCT Pub. Date: Apr. 16, 2009

(65) Prior Publication Data

US 2010/0206208 A1 Aug. 19, 2010

(30) Foreign Application Priority Data

Oct. 5, 2007 (DE) ..... 10 2007 048 077

(51) Int. Cl.
*B63H 25/00* (2006.01)

(52) U.S. Cl. ..... 701/21; 114/144 R; 114/144 RE

(58) Field of Classification Search ..... 701/21; 114/144 R, 144 RE

See application file for complete search history.

(56) References Cited

U.S. PATENT DOCUMENTS

| | | | |
|---|---|---|---|
| 3,774,568 | A | 11/1973 | Borst et al. |
| 4,225,148 | A | 9/1980 | Andersson |
| 4,531,427 | A | 7/1985 | Nilsson |
| 4,544,362 | A | 10/1985 | Arneson |
| 4,645,463 | A | 2/1987 | Arneson |
| 4,931,025 | A | 6/1990 | Torigai et al. |
| 4,939,660 | A | 7/1990 | Newman et al. |
| 5,118,315 | A | 6/1992 | Funami et al. |

(Continued)

FOREIGN PATENT DOCUMENTS

| | | | |
|---|---|---|---|
| CN | 1237524 | A | 12/1999 |

(Continued)

OTHER PUBLICATIONS

State Intellectual Property Office of the People's Republic of China. Notification of the First Office Action. 6 pages.

*Primary Examiner* — Ruth Ilan
(74) *Attorney, Agent, or Firm* — Davis & Bujold, P.L.L.C.

(57) ABSTRACT

A steering unit (1), for a steer-by-wire ship control system, comprises a steering wheel (3), a controller (11) that is connected to the electronic controller of the ship control system (ECU) via a CAN bus, a sensor (10) for detecting an angular position of the steering wheel (3), and a unit for generating mechanical resistance in the steering wheel (3), in which the unit for generating mechanical resistance in the steering wheel (3) is an electric motor (8) and the shaft (2) of the steering wheel (3), that is rotationally fixed to the steering wheel (3), is rotationally fixed to the rotor (7) of the electric motor (6), and the stator (8) of the electric motor (6) is rotationally fixed to the housing (5) of the electric motor (6).

18 Claims, 7 Drawing Sheets

U.S. PATENT DOCUMENTS

| | | | | |
|---|---|---|---|---|
| 5,167,546 | A | 12/1992 | Whipple | |
| 5,169,348 | A | 12/1992 | Ogiwara et al. | |
| 5,203,727 | A | 4/1993 | Fukui | |
| 5,326,294 | A | 7/1994 | Schoell | |
| 5,385,110 | A | 1/1995 | Bennett et al. | |
| 5,549,493 | A | 8/1996 | Bezzi | |
| 5,647,780 | A | 7/1997 | Hosoi | |
| 5,785,562 | A | 7/1998 | Nestvall | |
| 6,431,928 | B1 | 8/2002 | Aarnivuo | |
| 6,726,511 | B1 | 4/2004 | Schelman | |
| 6,843,195 | B2 | 1/2005 | Watabe et al. | |
| 6,899,196 | B2 | 5/2005 | Husain et al. | |
| 6,908,350 | B1 | 6/2005 | Roessler et al. | |
| 7,137,347 | B2 | 11/2006 | Wong et al. | |
| 7,295,905 | B2 | 11/2007 | Yao et al. | |
| 7,568,549 | B2 | 8/2009 | Wun et al. | |
| 2004/0139903 | A1 | 7/2004 | Watabe et al. | |
| 2005/0170712 | A1* | 8/2005 | Okuyama | 440/59 |
| 2006/0042532 | A1 | 3/2006 | Wong et al. | |
| 2006/0180070 | A1* | 8/2006 | Mizutani | 114/144 RE |
| 2007/0068438 | A1 | 3/2007 | Mizutani | |
| 2009/0241823 | A1* | 10/2009 | Borrett | 114/151 |

FOREIGN PATENT DOCUMENTS

| | | | |
|---|---|---|---|
| DE | 569 396 | | 1/1933 |
| DE | 31 30 518 | A1 | 4/1982 |
| DE | 42 13 561 | A1 | 10/1992 |
| DE | 101 58 870 | A1 | 5/2003 |
| DE | 10 2004 050 014 | A1 | 6/2005 |
| DE | 10 2005 036 686 | A1 | 12/2005 |
| DE | 699 22 397 | T2 | 12/2005 |
| DE | 11 2004 001 258 | T5 | 10/2006 |
| EP | 0 102 579 | A2 | 3/1984 |
| EP | 1 770 008 | A2 | 4/2007 |
| EP | 1 792 802 | A2 | 6/2007 |
| JP | 2-279495 | A | 11/1990 |
| WO | 99/22989 | A1 | 5/1999 |

* cited by examiner

STEERING UNIT FOR A STEER-BY-WIRE SHIP'S CONTROL SYSTEM AND METHOD FOR OPERATING THE STEERING UNIT

This application is a National Stage completion of PCT/EP2008/062897 filed Sep. 26, 2008, which claims priority from German patent application serial no. 10 2007 048 077.8 filed Oct. 15, 2007.

FIELD OF THE INVENTION

The present invention relates to a steering unit for a steer-by-wire ship control system. Furthermore, the invention relates to a method for operation of the steering unit.

BACKGROUND OF THE INVENTION

Steer-by-wire systems are known from the prior art which can also be used in ship control engineering. In systems of this type, the steering commands input via a steering unit are detected by a sensor and passed, via a control unit, to an actuator, which executes the steering command. In an advantageous manner, no mechanical connection exists between the helm (steering wheel) and the rudder and/or in the case of a motor vehicle, between the steering wheel and the steered wheels.

In ship control engineering, the steering units connected to the helm are usually hydraulically actuated, which has the adverse result of poor dynamics as well as high maintenance costs.

A steer-by-wire ship control system is known, for example, from U.S. Pat. No. 6,431,928 B1. In the known system, an electric motor is used to rotate the entire propeller propulsion unit via a mechanical power train, wherein the electric motor is controlled by a control unit, which is connected firstly to the steering unit to receive steering command information, and secondly to a sensor which detects the steering position information.

From U.S. Pat. No. 7,137,347 B2 a steering unit is known for a steer-by-wire ship control system which has a mechanically flexible steering device, for example a helm, a sensor to detect the rotational motion of the helm, and a stop mechanism for blocking of any additional rotational movement of the helm to starboard or port when the ship rudder has reached an extreme starboard or port position.

From EP 1770008 A2 a steer-by-wire ship control system is known which comprises at least two steering units. In this case, the rudder is actuated by means of a hydraulically operated actuator based on the steering signals, which are generated by the steering unit that requires the faster movement of the rudder. In the known system, the steering units each comprise a helm, which is connected to a control device, which in turn is connected to a control network.

Furthermore, in the case of actuation or rotation of the helm as a function of signals from a sensor to detect the rudder position, it is provided that the steering devices produce a mechanical resistance by means of a coupling, wherein the resistance is greater the closer the rudder approaches an end position. Once an end position is reached, the mechanical resistance on the helm is adjusted such that an additional rotational movement thereof in the same direction is not possible. This is affected by means of a coupling, which in the fully closed position allows no rotational movement of the helm.

Furthermore, from U.S. Pat. No. 6,843,195 B2 a control system is known for an outboard motor in which the quotient "implemented steering angle/steering angle input via the helm" decreases with increasing speed.

SUMMARY OF THE INVENTION

It is the object of the present invention to specify a steering unit for a steer-by-wire ship control system which has a compact design and is easily produced. Furthermore, the steering unit should be highly dynamic. In addition, a method for operation of the steering unit that increases the dependability and ease of use is to be specified.

Accordingly, a steering unit is proposed for a steer-by-wire ship control system, which comprises a helm (steering wheel), a controller, and a device to produce mechanical resistance on the helm, wherein the device to produce mechanical resistance on the helm is designed as an electric motor. In this case, the shaft of the helm that is fixed to the helm in a non-rotational manner is fixed to the rotor of the electric motor in a non-rotatable manner, and the stator of the electric motor is rotationally fixed to the housing of the electric motor. According to the invention, the electric motor can also be used to restore the helm to a defined position or to the starting position.

Furthermore, within the scope of a particularly favorable embodiment, the invention specifies that the shaft rotationally fixed to the helm passes through the rotor, wherein preferably at the end of the shaft facing away from the helm, an incremental encoder is arranged to detect the angle of rotation of the helm. To control the electric motor and to transfer the steering angle adjusted via the steering unit, a controller connected to the incremental encoder and the electric motor is provided, which is connected via a CAN-bus to the electronic controller of the ship control system ECU.

The electric motor is designed preferably as a vector-controlled motor and allows a sinusoidal or trapezoidal signal conversion, so that DC or AC motors can be used.

According to a particularly favorable embodiment of the invention, the electric motor is designed as a vector-controlled, brushless torque motor. This results in a compact design, large torques at low RPM, high dynamic response and minimal circumferential backlash. According to the invention, the torque motor is designed so that it generates a constant torque across the speed range, so that there is no need to install reduction gears. A motor of this kind can be overloaded, in a favorable manner, by 100% for a period of 5 seconds; by comparison, a hydraulic system can be overloaded only by 20%.

BRIEF DESCRIPTION OF THE DRAWINGS

The steering unit as per this invention and the method of its operation are explained in greater detail below based on the attached figures. Wherein.

DETAILED DESCRIPTION OF THE PREFERRED EMBODIMENTS

Figure 1:
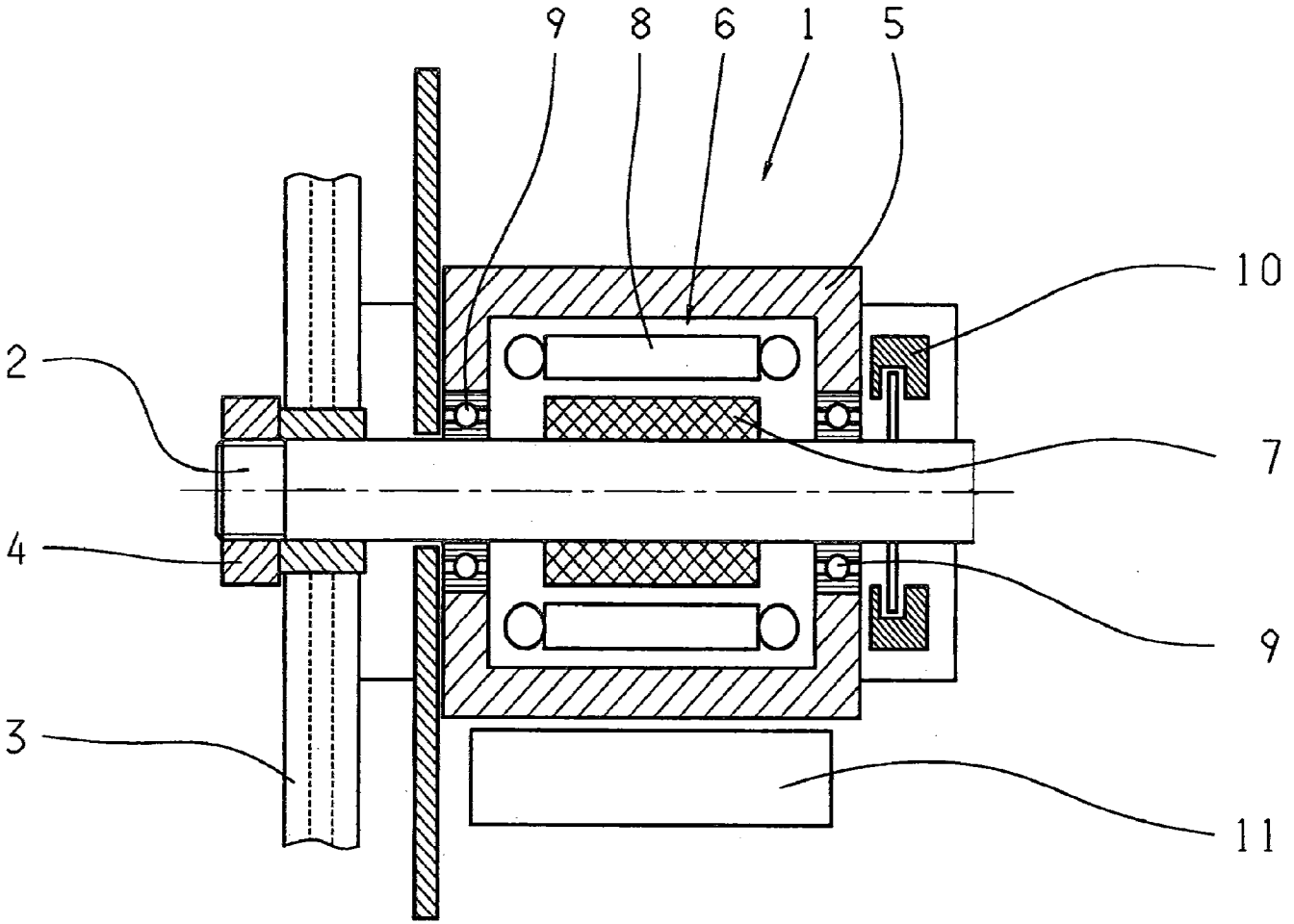
FIG. 1: A schematic, cross-sectional view of a preferred embodiment of a steering unit according to the invention.

FIG. 1 is a first embodiment of a steering unit 1 as per the invention. It comprises a helm 3 fixed to a shaft 2 in a non-rotatable manner. In the illustrated embodiment, the shaft is connected to the helm via a screw nut 4.

As the device to produce a mechanical resistance to the steering movement, an electric motor 6 is arranged in a housing 5. The rotor 7 of the motor in the illustrated example is designed as a hollow shaft through which the shaft 2 passes, wherein the shaft 2 is fixed to the rotor 7 in a non-rotatable manner. The connection between rotor 7 and shaft 2 can be implemented, for example, by welding or by positive fit; it is also possible that the connection be made by means of a suitable profile, for example a spline profile. The housing 5 of the electric motor can be made of aluminum, steel, or cast iron.

As is evident in FIG. 1, the stator 8 of the electric motor 6 is fixed to the housing 5 in a non-rotatable manner. Furthermore, the shaft 2 is seated by means of bearings which are designed preferably as angular-contact ball bearings 9. To detect the angle of rotation of the helm, a sensor 10 is provided which is designed preferably as an incremental encoder in order to keep manufacturing costs low. As an alternative to the design comprising an incremental encoder, the sensor can be designed as an absolute position sensor.

In the embodiment shown in FIG. 1, the sensor 10 is arranged at the end of the shaft 2 facing away from the helm 3; alternatively, the sensor can be arranged at any other suitable location, for example, between the helm 3 and the electric motor 6 and/or its housing 5, wherein in the latter case, the passage of the shaft 2 through the rotor 7 is not necessary, so that the rotor 7 need not be designed as a hollow shaft. The sensor signals are used as input quantities for the motor control 11, which is connected preferably via a CAN bus to the electronic control of the ship control system.

In the illustrated embodiment, the ratio between the moment of inertia of the helm 3 and the moment of inertia of the rotor 7 of the electric motor is preferably on the order of 1/2.5.

According to the invention, a torque of between 0 and 15 Nm is produced by the electric motor, which represents the mechanical resistance against the steering movement.

Figure 2:
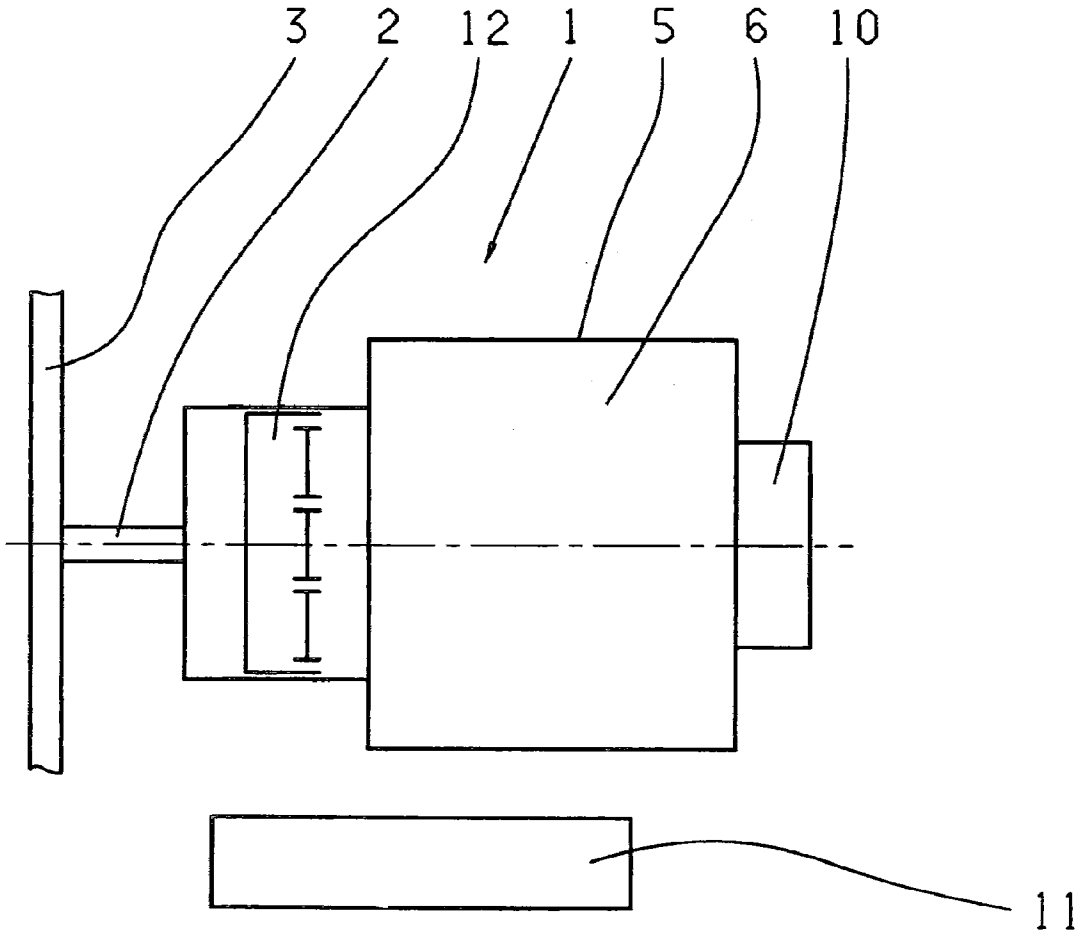
FIG. 2: A schematic, cross-sectional view of another embodiment of a steering unit according to the invention.

According to another embodiment of the invention, which is the subject of FIG. 2, a planetary transmission 12 can be arranged between the helm 3 and the electric motor 6 of the steering unit; the planetary transmission acts as a reducing gear, so that the electric motor 6 can be of smaller size. In this case, the transmission ratio of the planetary transmission is taken into account in the motor controller 11 in order to compute the steering angle set by the helm from values supplied from the sensor 10.

In a design of this kind, according to the invention the ratio between the moment of inertia of the helm 3 and the moment of inertia of the rotor 7 of the electric motor is preferably on the order of $1/2.5*i^2$, wherein i represents the gear ratio of the planetary gear 12. From this it is evident that in order to satisfy this condition, the moment of inertia of the rotor 7 can be smaller than for a design without an intermediately positioned planetary transmission.

Figure 3:
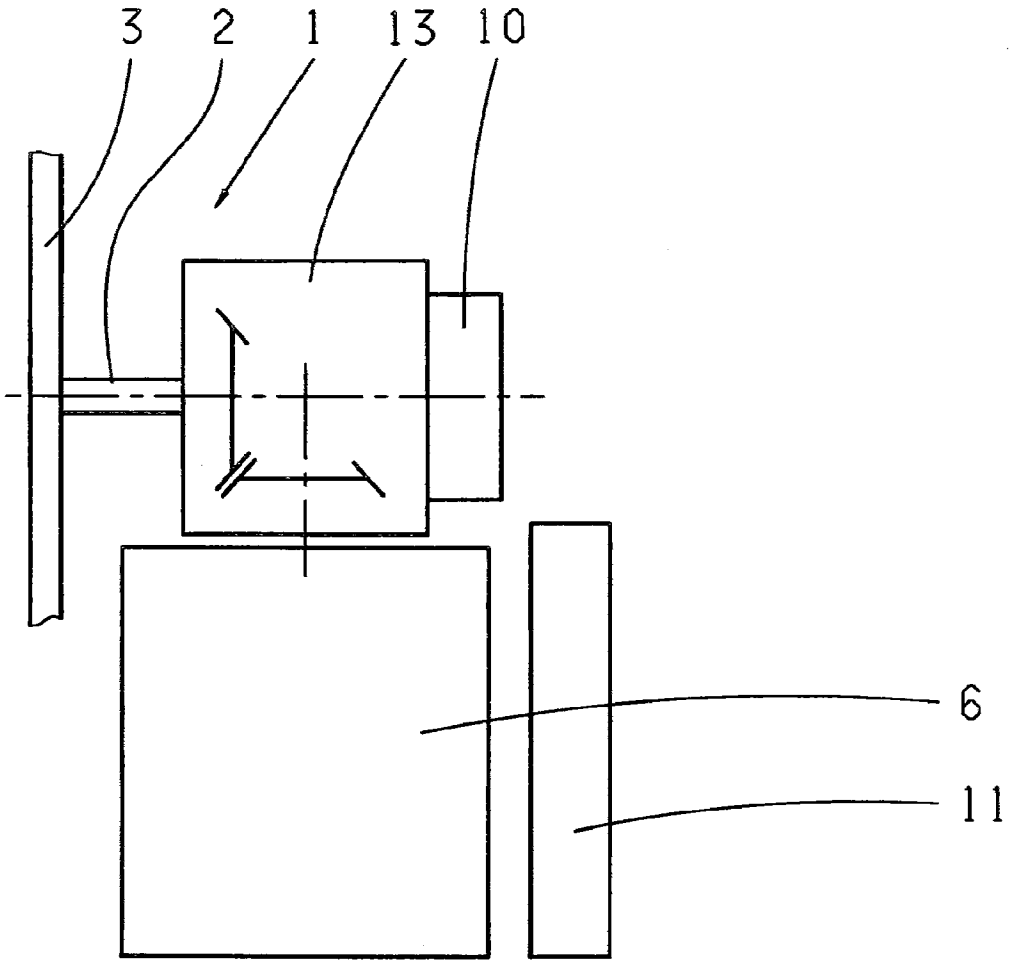
FIG. 3: A schematic, cross-sectional view of a third embodiment of a steering unit according to the invention.

The subject of FIG. 3 is an embodiment in which a bevel gear 13 is arranged between the helm 3 and the electric motor 6. In this way, firstly the existing install space can be optimally used, and secondly, a smaller dimensioning of the motor will be possible due to the translation of the bevel gear. In the illustrated example, no conversion of the values of the sensor 10 is needed in order to determine the desired steering angle, since no transmission ratio is provided between the helm and sensor.

Within the scope of a particularly favorable embodiment of the invention, the electric motor 6 is designed as a vector-controlled, brushless torque motor such that it produces a constant torque across the RPM range.

Figure 4:
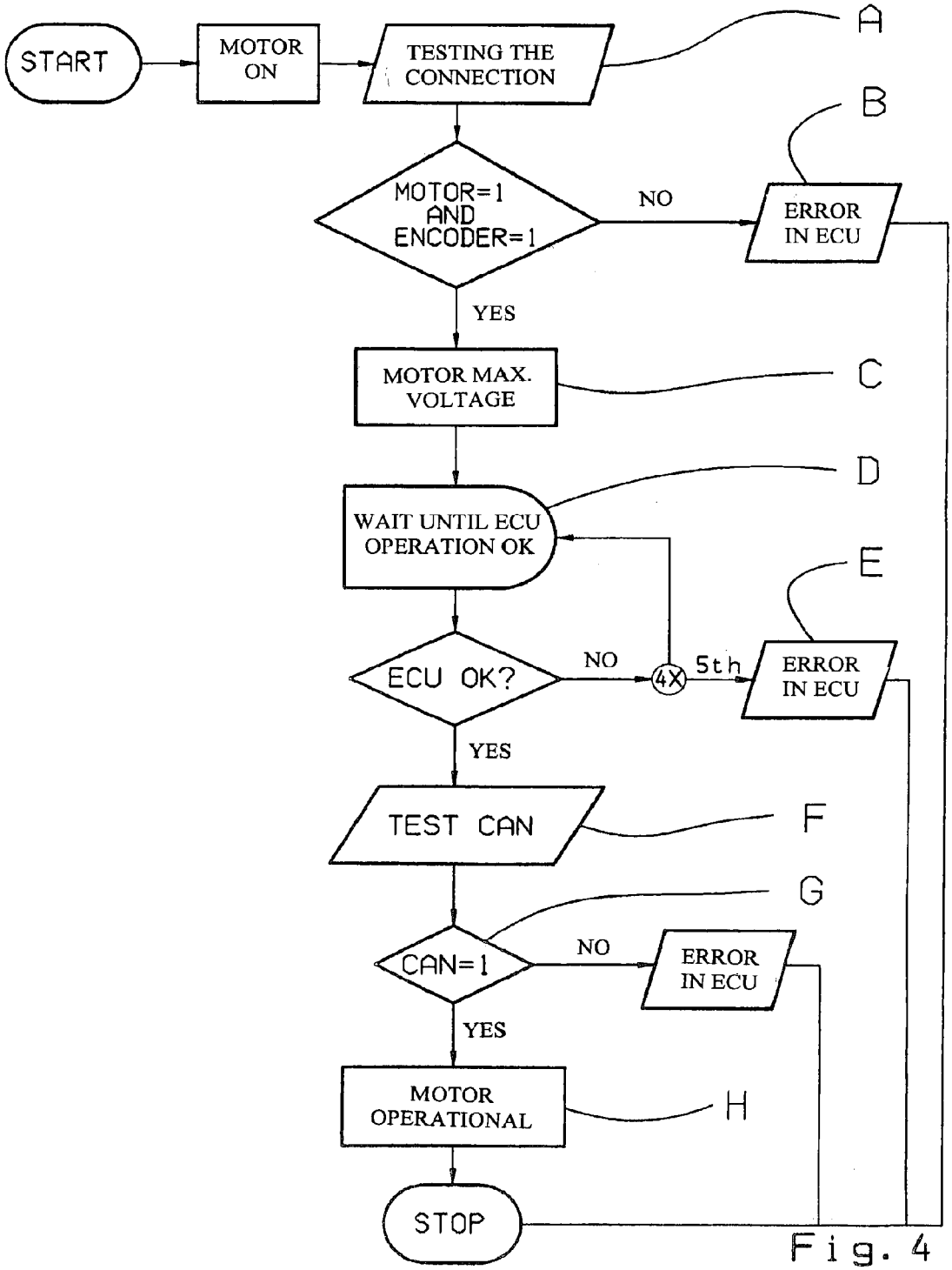
FIG. 4: A schematic flow chart, which illustrates the initializing process and testing of CAN functionality.

According to the invention and with reference to FIG. 4, upon start-up of the ship control system, and optionally after determining the straight-ahead position or the desired starting position of the rudder by the motor controller 11, the connections between the motor controller and the electric motor 6 and between the motor controller and the sensor 10 are tested (step A). If both connections are functioning, the electric motor is operated for a defined time at maximum current, so that the helm cannot be moved until the electronic controller of the ship control system (ECU) is operationally ready (step C, D); if one of the connections is not functioning, the corresponding notice is sent to the ECU (step B) and an error message is output.

If the electronic controller of the ship control system is operationally ready, the CAN can be tested (step F). After passage of a defined time, if the ECU is not operationally ready, the motor 6 remains under maximum current for an additional time interval which corresponds to the defined time, until the ECU is operational, wherein this process is repeated up to n times, wherein n is a default, natural number (in the example shown in FIG. 4, the process is repeated up to four times). After the last repetition of the process, if the ECU is not operationally ready, the corresponding notice is sent to the ECU (step E) and an error message is output.

If the ECU is operationally ready, the functioning of the CAN communication is tested (step F), and if the CAN communication is not functioning, the corresponding notice is sent to the ECU. If the CAN communication is operationally ready (step G), that is, if each device connected to the CAN has an allocated address, then the current to the electric motor 6 is cut back or reduced (step H); the steering unit is operational.

According to the invention, a non-reset zone is defined about the neutral position of the helm(i.e., the starting position before implementation of the steering movement), whereby if the angle of rotation and/or the angular position of the helm is within this zone during a steering operation by the user, the helm will not be reset to the neutral position by actuation of the motor; for example, this zone can be defined as the region between +90° and −90° about the present neutral position of the helm (i.e. the starting position before implementation of the steering movement). If the motor is not powered, then the helm remains at the angular position selected by the user.

Furthermore, a reset zone is defined, so that if the angle of rotation and/or the angular position of the helm after a steering actuation by the user is within this zone, then the helm will be reset by the electric motor at constant speed, preferably 18 revolutions per minute, to the present neutral position of the helm, or to a position in the non-reset zone; this zone is preferably defined as the region between the ends of the non-reset zone and 90% of the maximum possible number of helm revolutions in the clockwise and counterclockwise direction, whereby the maximum possible number of helm revolutions is determined preferably upon startup of the motor. According to the invention, the reset function in the motor controller can be deactivated, and in this case the behavior of the steering unit corresponds to the behavior at an angle of rotation within the non-reset zone.

Due to the division into zones and the described zone-dependent control of the electric motor, dependability and ease of operation are improved.

According to the invention, the regions between 90% and 100% of the maximum possible number of helm revolutions both clockwise and counterclockwise are defined as the boundary zone and/or as regions in which the electric motor is operated such that the helm cannot be moved, or can only be moved with application of considerable force (these forces are greater than the forces needed to move the helm when the angular position thereof is located within the reset zone) in the direction of the steering movement. These forces are preferably greater the more the revolutions of the helm approach the maximum possible number of helm revolutions, and within the scope of one favorable embodiment of the invention, it is provided that the helm be reset by the electric motor at constant speed to a defined position within the reset zone, for example, 90% of the maximum possible number of helm revolutions or to a position within the non-reset zone. For example, in this range the current assumes values between 2 A and 7.4 A. Within the framework of another design embodiment, the current in the regions between 90% and 100% of the maximum possible number of helm revolutions clockwise and counterclockwise is constant and has a maximum value, for example 7.2 A.

According to additional variants of the invention, the definition of the zones can be varied, so that the boundary zone, for example, begins at Y % of the maximum possible number of helm revolutions both clockwise and counterclockwise, wherein Y can assume a value between 45 and 95; also, the non-reset zone can be defined as the region between +X° and −X° about the present neutral position of the helm, wherein X can assume values in the interval between 1° and 135°.

Accordingly, the invention provides that the mechanical resistance at the helm (i.e. the current at which the motor is operated) produced by the electric motor upon actuation of the helm by the user, is a function of the speed in both the reset zone and in the non-reset zone, wherein the resistance increases preferably linearly with an increase in speed up to a default limiting value, whereby in the boundary zone, as explained above, the resistance either has a constant maximum value, or in the absence of rotations and up to the maximal possible number of rotations, increases to the maximum value. Due to this design, the dependability is increased, since very fast maneuvers at high speeds are largely avoided.

In the event that no zones are defined, the invention likewise provides that the mechanical resistance on the helm, produced by the electric motor upon actuation of the helm by the user, is a function of the speed, wherein the resistance increases preferably linearly with increasing speed up to a default limiting value.

Preferably, a speed is defined below which the current to the electric motor is zero, so that no mechanical resistance is produced with a movement of the helm, wherein above this speed the current increases and a mechanical resistance is produced. For example, the electric motor of the steering unit produces no torque at a speed less than 10 kn, wherein above this speed, the current is adjusted between 0.7 A and 2 A (default limit value). According to the invention, this should correspond to a torque between 0 and 15 Nm. Furthermore, the invention provides that if an autopilot is engaged, the mechanical resistance will take on a large, constant value at any speed. For example, the torque can be 12 Nm, which corresponds to a current of 1.8 A in the electric motor described in the examples.

Figure 5:
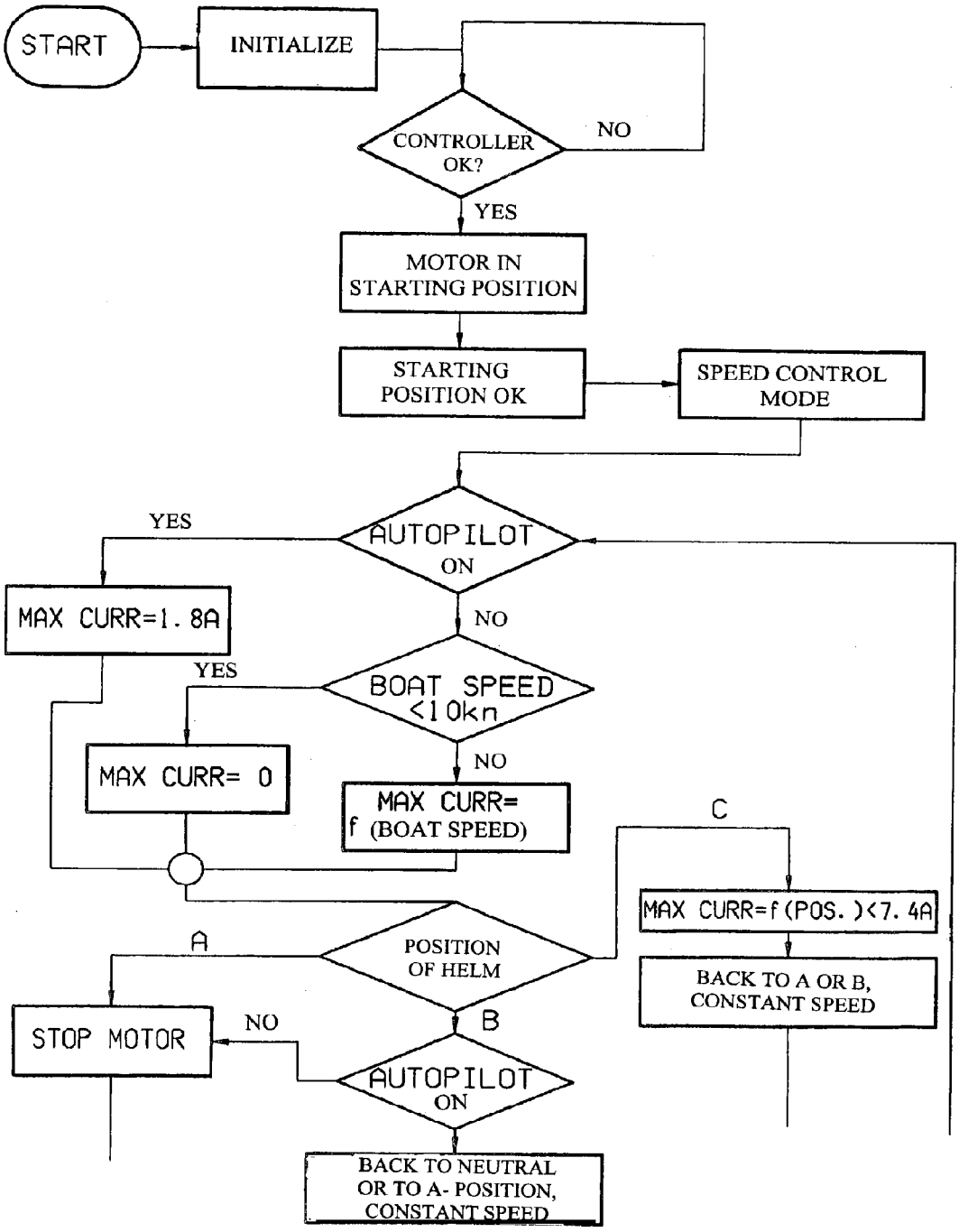
FIG. 5: A schematic flow chart to illustrate the different operating modes of the steering unit.

The procedure described above is illustrated based on FIG. 5, which represents a schematic flow chart of one version of the method. First, the parameters are initialized in the motor controller 11 and a check is run to determine whether the motor controller is operational. If this is the case, then the corresponding message is transmitted to the ECU and the controller changes over to speed-control mode. Then a check is run to determine whether an auto-pilot device is activated, and if this is the case, then the current for operation of the electric motor to produce the mechanical resistance will assume a maximum value of 1.8 A. If no auto-pilot device is activated and if the speed of the ship is less than 10 knots per hour, then the maximum current is zero; otherwise the maximum current is a function of ship speed.

After the conclusion of actuation of the helm by the user, the subsequent procedure will depend on in which zone or in which region the helm is located after the steering operation. If the helm is located within the non-reset zone (zone A), the motor will be switched off, and if the helm is located within the reset zone (zone B) and the reset function is activated, with an activated auto-pilot device, the helm will be reset at a constant speed to zone A or to the straight-ahead position. If the auto-pilot device is not activated, then the motor is switched off. If the helm is located in a region between 90% and 100% of the maximum possible number of helm revolutions, the electric motor will be operated at a current which is higher, the closer the helm is to the maximum possible number of helm revolutions, whereby the maximum current of the electromotor described in the examples is 7.4 A. In this way the helm is returned at a constant speed to zone B or zone A.

As was already explained, a motor designed as vector-controlled, brushless torque motor is preferably used as the electric motor, which is controlled as follows to produce the mechanical resistance.

Figure 6:
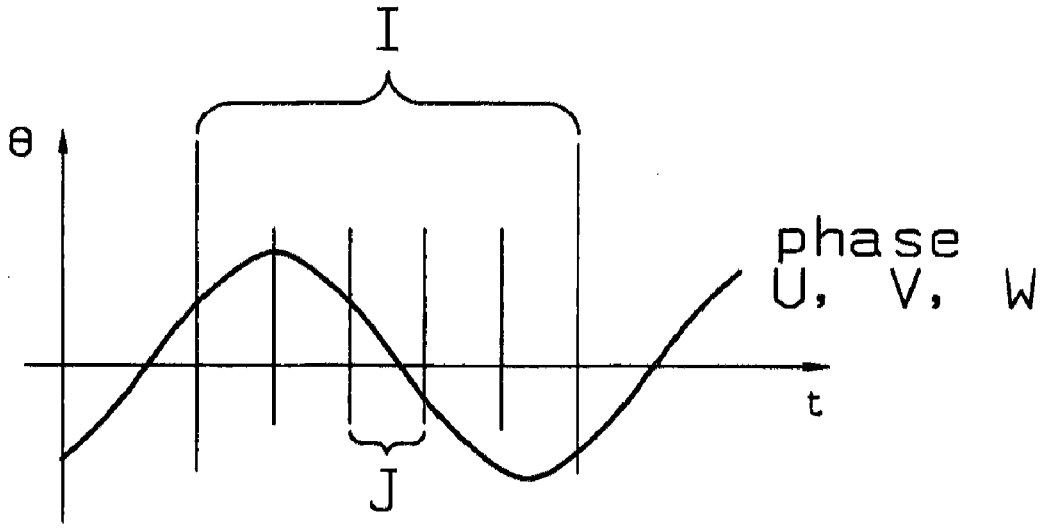
FIG. 6: A diagram which illustrates the progression of one phase of the motor control as a function of time, as well as the resolution of the incremental encoder.

The motor controller 11 features the same physical resolution as the incremental encoder 10, wherein this resolution is multiplied by a factor of 4 in order to allow for the discretization with respect to the three phases U, V, and W, as illustrated with reference to FIG. 6. A diagram is presented in FIG. 6, which represents the curve of one of the phases U, V, W (angle θ) of the motor controller as a function of time, as well as the resolution I of the incremental encoder. Furthermore, in the figure the resolution J of the motor controller is illustrated after the discretization, which is preferably greater by a factor of 4 than the resolution of the incremental encoder 10. Preferably an incremental encoder with a resolution of 2048 pulses per revolution is used, so that the resolution in the motor controller will be 8192 pulses per revolution.

If the incremental encoder detects no movement of the shaft and thus of the helm, then the rotor remains in the same position, which serves as neutral position; if the incremental encoder detects a rotational movement of the rotor, then according to the invention the phases of the motor are inverted, so that the motor will produce a torque opposite the rotational movement of the helm implemented by the user. Within the framework of an additional embodiment of the invention, the level of the torque produced by the motor is proportional to the level of the torque applied by the user and/or to the rotation of the helm produced thereby.

Figure 7:
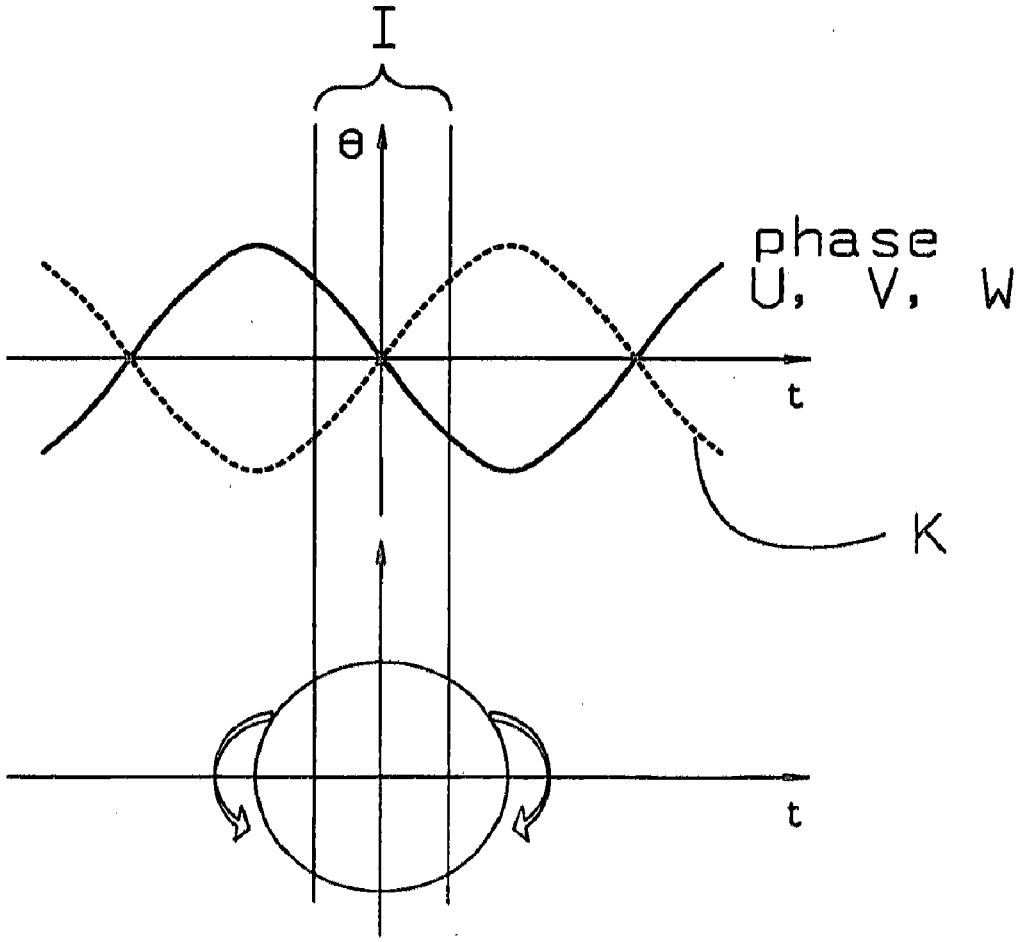
FIG. 7: A diagram which represents the current phase of the motor and the inverted phase as a function of time, as well as the corresponding movement of the helm.

This process is illustrated with reference to FIG. 7, which in the upper part shows a diagram which represents the current phase U, V, W of the motor and the inverted phase (curve K) as a function of time; the resolution of the incremental encoder is denoted by I as in FIG. 6. In the lower part of the figure there is a schematic representation of the movement of the helm, shown both clockwise and counterclockwise.

Figure 8:
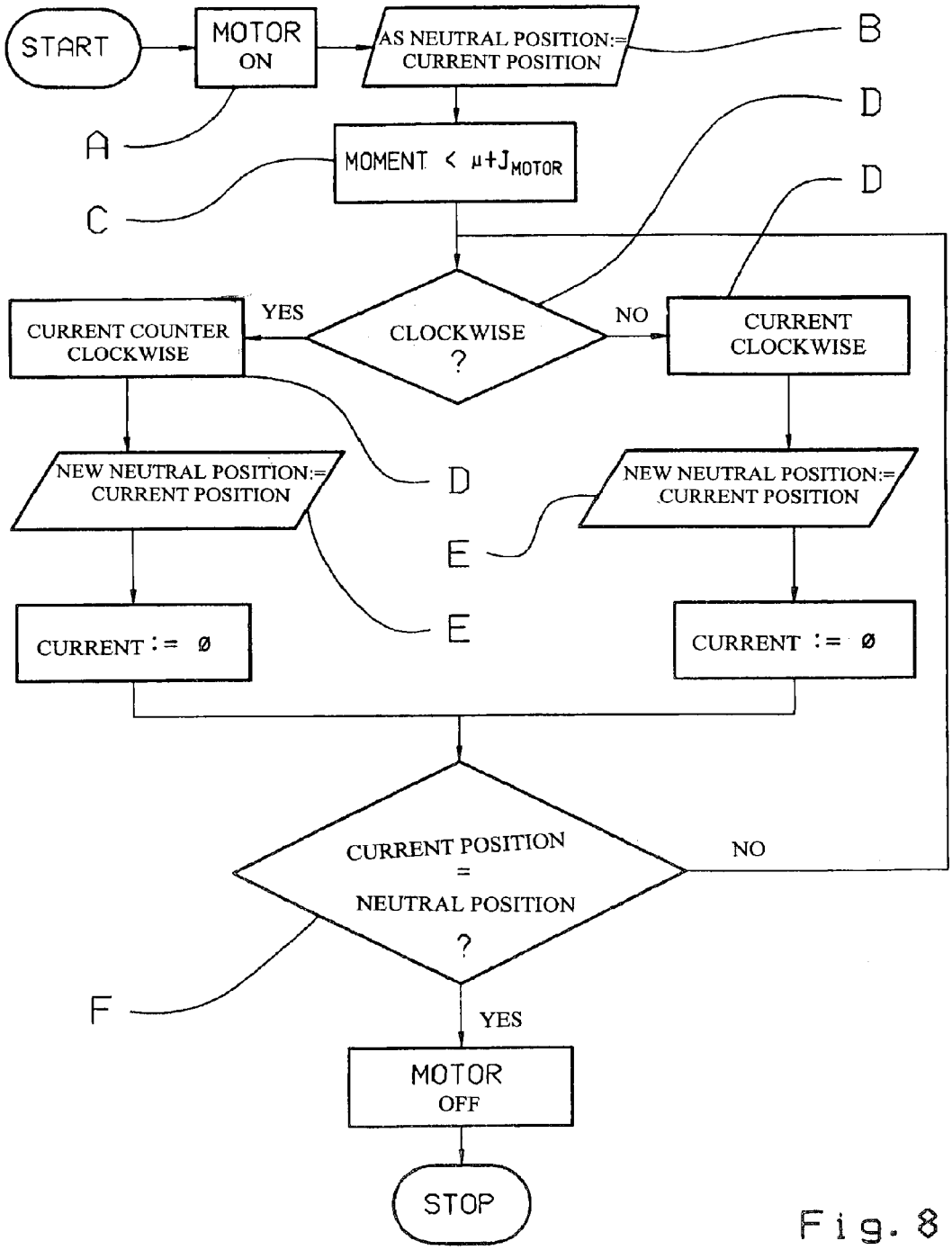
FIG. 8: A schematic flow chart of the motor control to generate a mechanical resistance against the driver's steering movement.

The neutral position of the rotor according to the invention is redefined after each completed steering movement, as explained with reference to FIG. 8, which presents a schematic flow chart of the motor control to produce a mechanical resistance opposite the steering movement of the driver.

At the beginning of the control, the electric motor is switched on and the rotor is not moved, wherein the current position of the incremental encoder is defined as the neutral position, which corresponds to the absolute neutral position, preferably the straight-ahead position (steps A, B). If the torque acting on the rotor is greater than the moment of friction and the moment of mass inertia of the rotor (step C), a determination is made as to whether the rotational movement caused thereby is in a clockwise or counterclockwise direction, whereby the motor will be controlled such that it produces a torque opposite the rotational movement produced by the steering movement (step D). After completion of activation of the helm by the user, the current position of the incremental encoder is defined as the new neutral position (step E) and the current will assume a value zero. Next, a check is made to determine whether the current position of the incremental encoder coincides with the absolute neutral position (step F). If the current position of the incremental encoder coincides with the absolute neutral position, then the electric motor is switched off; if this is not the case, then steps D and E are repeated. This will ensure that upon return to the absolute neutral position, the motor will not produce any torque.

The steering unit according to this invention can be used independently of the type of actuator connected to the rudder in steer-by-wire ship control systems. For example, the actuator can be designed as a hydraulic or electromechanical actuator.

The ECU processes the signals from the steering unit actuated by the user or from an auto-pilot device and sends them to the steering actuator. Here the steering actuator is operated according to the settings of the steering unit and the ECU with regard to the steering angle and the rotational speed of the rudder. In the event that an auto-pilot device is activated, the rudder position is updated continually in the motor controller of the steering unit.

REFERENCE NUMERALS

1 Steering unit
2 Shaft
3 Helm
4 Screw nut
5 Housing
6 Electric motor
7 Rotor
8 Stator
9 Bearing
10 Sensor
11 Controller
12 Planetary gear
13 Bevel gear drive

The invention claimed is:

1. A method of operation of a steering unit (1) for a steer-by-wire ship control system, in which the steering unit comprises a steering wheel (3), a controller (11) that is connected to an electronic controller of the ship control system (ECU) via a CAN bus, a sensor (10) for detecting an angular position of the steering wheel (3), and an electric motor (6) for generating mechanical resistance in the steering wheel, the method comprising the steps of:

when an auto-pilot device is unactivated, producing the mechanical resistance of the steering wheel via the electric motor (6) as a function of a speed upon actuation of the steering wheel (3) by an operator; and increasing the resistance by increasing speed up to a default limit value, and when the auto-pilot device is activated, the mechanical resistance assuming a constant large value at any speed.

2. The method according to claim 1, further comprising the steps of:

defining a speed at which the current to the electric motor (6) is zero so that no mechanical resistance is produced during a movement of the steering wheel (3); and producing the mechanical resistance by increasing the current above the speed as a function of the speed up to a default limit value.

3. The method according to claim 1, further comprising the steps of:

upon startup of the ship control system and after the motor controller (11) determines a straight-ahead position or the desired starting position of the steering wheel, testing connections between the motor controller (11) and the electric motor (6) and between the motor controller (11) and the sensor (10);

if both connections are functioning, operating the electric motor (6) at a maximum power for a defined time such that the steering wheel (3) cannot be moved until the electronic control of the ship control system (ECU) is operational;

if one of the connections is not functioning, outputting an appropriate message to the ECU and an error message;

if the electronic control of the ship control system is operational, testing the CAN;

if after passage of a defined time the ECU is not operational, maintaining the electric motor (6) under maximum power for an additional time interval which corresponds to the defined time until the ECU is operational;

repeating this process a default plurality of (n) times; and if after the final repetition of the process the ECU is not operational, sending the corresponding message to the ECU and an error message is output.

4. The method according to claim 3, further comprising the steps of:

if the ECU is operational, testing the availability of the CAN communication;

if the CAN communication is not functioning, then sending a corresponding message to the ECU; and if the CAN communication is operational, reducing the power to the electric motor (6).

5. The method according to claim 1, further comprising the steps of:

when the electric motor (6) is designed as a vector-controlled brushless torque-motor whose rotor (7) is rotationally fixed to the shaft (2) which is rotationally fixed to the steering wheel (3) and the sensor (10) is designed as incremental generator, maintaining the rotor (7) in the same position as long as an incremental encoder detects no movement of a shaft (2); and when the incremental encoder detects rotational movement of the rotor, then inverting phases of the electric motor (6) such that the electric motor generates a torque opposite the rotational movement of the steering wheel (3) implemented by the operator.

6. The method according to claim 5, further comprising the step of producing a level of torque, via the electric motor (6), that is proportional to at least one of a level of torque applied by the operator and rotation of the steering wheel produced thereby.

7. The method according to claim 5, further comprising the steps of:

switching the electric motor on at the beginning of the control of the electric motor (6);

defining the current position of the incremental encoder as the neutral position which corresponds to a defined absolute neutral position;

if torque acting on the rotor (6) due to operation of the steering wheel (3) by the operator is greater than a coefficient of friction and a moment of mass inertia of the rotor, then determining whether the rotational movement is in either a clockwise direction or a counterclockwise direction; and controlling the electric motor (6) such that the electric motor (6) produces a torque opposite to the rotational motion produced by the steering movement.

8. The method according to claim 7, further comprising the steps of:

after completion of the operation of the steering wheel (3) by the operator, defining the current position of the incremental encoder as the new neutral position and the current assumes the value zero;

determine whether the current position of the incremental encoder coincides with the absolute neutral position;

if the present position of the incremental encoder coincides with the absolute neutral position, then switching the electric motor off; and if the present position of the incremental encoder does not coincide with the absolute neutral position, continuing to keep the electric motor on and controlling the electric motor in a manner such that the electric motor produces a torque opposite the rotational motion produced by the steering movement.

9. A method for operation of a steering unit (1) for a steer-by-wire ship control system in which the control unit comprises a steering wheel (3), a controller (11) that is connected to an electronic controller of the ship control system (ECU) via a CAN bus, a sensor (10) for detecting an angular position of the steering wheel (3), and an electric motor (6) for generating mechanical resistance in the steering wheel, the method comprising the step of:

defining a non-reset zone, a reset zone, and a boundary zone around a current neutral position of the steering wheel (3);

detecting the angular position of the steering wheel (3);

if the angular position of the steering wheel during a steering operation by the operator is within the non-reset zone, avoiding restoration of the steering wheel to the current neutral position through actuation of the motor;

if the angular position of the steering wheel (3) is located within the reset zone after a steering operation by the operator, then restoring the steering wheel at constant speed to either the current neutral position of the steering wheel or to a position in the non-reset zone; and if the angular position of the steering wheel (3) is located within the boundary zone after a steering operation by the user, then operating the electric motor (6) such that the steering wheel (3) either cannot be moved, or can only be moved with application of considerable force, in the direction of the steering movement, and is restored at a constant speed to either a defined angular position within the reset zone or to a defined position within the non-reset zone.

10. The method according to claim 9, further comprising the steps of:

defining the non-reset zone as a region between +1° (+X°) and 135° (X°) about the current neutral position of the steering wheel, defining the reset zone as the region between ends of the non-reset zone and 45% to 95% of a maximum possible number of steering wheel rotations in a clockwise direction and in a counterclockwise direction; and defining a limit zone as the regions between 45% to 95% and 100% of a maximum possible number of steering wheel rotations in the clockwise direction and the counterclockwise direction.

11. The method according to claim 9, further comprising the steps of:

when no auto-pilot device is activated, operating the electric motor such that the mechanical resistance of the steering wheel produced by the electric motor upon actuation of the steering wheel by the operator in the reset zone and in the non-reset zone as a function of the speed, such that the resistance increases with increasing speed up to a default, limit value; and when an auto-pilot device is activated, operating the electric motor such that the mechanical resistance assumes a constant large value at any speed, and at the boundary zone of the resistance, has either a constant maximum value, or in the absence of rotations and up to the maximal possible number of rotations, increases to the maximum value.

12. The method according to claim 11, further comprising the step of:

defining a speed below which the current to the electric motor (6) is zero such that no mechanical resistance is produced during movement of the steering wheel (3), and above this speed, the current increases as a function of the speed up to a default limit value and producing a mechanical resistance, when the auto-pilot device is unactivated and the angular position of the steering wheel (3) is located in either the reset zone or the non-reset zone.

13. A method of operating a steering unit for a steer-by-wire ship control system, in which the steering unit comprises a steering wheel, a controller that is connected to an electronic controller of a ship control system (ECU), a sensor for detecting an angular position of the steering wheel, and a device for generating mechanical resistance at the steering wheel, the method comprising the steps of:

generating the mechanical resistance at the steering wheel, by the device for generating mechanical resistance at the steering wheel upon actuation of the steering wheel by an operator, as a function of a speed of the ship;

raising the mechanical resistance at the steering wheel as the speed of the ship increases until a predetermined threshold value is reached; and if an auto-pilot device is activated, maintaining the mechanical resistance at a constant value for every speed.

14. The method of operating a steering unit for a steer-by-wire ship control system according to claim 13, further comprising the steps of defining a speed, below which no mechanical resistance is generated by pivoting the steering wheel, and above this speed, the mechanical resistance generated by the device for generating mechanical resistance at the steering wheel is increased up to the predetermined threshold value as a function of the speed.

15. A method of operating a steering unit for a steer-by-wire ship control system in which the steering unit comprises a steering wheel, a controller that is connected to an electronic control unit of a ship control system (ECU), a sensor for detecting the angular position of the steering wheel, and a device for generating mechanical resistance at the steering wheel, the method comprising the steps of:

defining a non-reset zone, a reset zone, and a boundary zone in a range of angular positions of the steering wheel with respect to a current zero-position of the steering wheel, if the steering unit has a device for resetting the steering wheel;

if the angular position of the steering wheel, during a steering actuation by an operator, is within the non-reset zone, then delaying resetting the steering wheel to the current zero-position of the steering wheel;

if the angular position of the steering wheel, after a steering actuation by the operator, is within the reset zone, then resetting the steering wheel with the device for resetting the steering wheel at a constant speed to either the current zero-position of the steering wheel, or a position in the non-reset zone; and if the angular position of the steering wheel, after a steering actuation by the operator, is within the boundary zone, then operating the device for resetting the steering wheel such that the steering wheel either cannot be moved further in a direction of the steering movement, or can only be moved in the direction of the steering movement with considerable force, and is reset at a constant speed to either a defined angular position within the reset zone or a defined position within the non-reset zone.

16. The method of operating a steering unit for a steer-by-wire ship control system according to claim 15, further comprising the steps of:

defining the non-reset zone as an angular region between +1° and 135° around the current zero-position of the steering wheel;

defining the reset zone as angular regions between ends of the non-reset zone and 45 to 95% of a maximum possible number of steering wheel revolutions in a clockwise direction and a counterclockwise direction; and defining the boundary zone as angular regions between 45 to 95% and 100% of a maximum possible number of steering wheel revolutions in the clockwise direction and the counterclockwise direction.

17. The method of operating a steering unit for a steer-by-wire ship control system according to claim 15, further comprising the steps of:

depending on a speed of the ship, if no auto-pilot device is activated, increasing the mechanical resistance generated at the steering wheel up to a predetermined threshold value, and the mechanical resistance is generated at the steering wheel by the device for generating mechanical resistance during an actuation of the steering wheel by the operator in either the reset zone and the non reset-zone; and maintaining the mechanical resistance at a constant predetermined value at every speed of the ship, if an auto-pilot device is activated, and in the boundary zone, and the mechanical resistance is either at a constant maximum value or is increased up to the maximum value, depending on a number of revolutions to go before achieving the maximum possible number of steering wheel revolutions.

18. The method of operating a steering unit for a steer-by-wire ship control system according to claim 17, further comprising the steps of:

defining a speed, below which no mechanical resistance is generated by movement of the steering wheel and, above this speed, the mechanical resistance is increased up to a predetermined threshold value, as a function of the speed, if no auto-pilot device is activated, and the angular position of the steering wheel is within either the reset zone or the non-reset zone.

* * * * *